US009109416B2

(12) United States Patent
Xu

(10) Patent No.: US 9,109,416 B2
(45) Date of Patent: Aug. 18, 2015

(54) ONE TRIP TUBULAR CLEANING AND DRILLING ADDITIONAL OPEN HOLE

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 664 days.

(21) Appl. No.: 13/428,285

(22) Filed: Mar. 23, 2012

(65) Prior Publication Data

US 2013/0248249 A1 Sep. 26, 2013

(51) Int. Cl.
*E21B 37/00* (2006.01)
*E21B 12/00* (2006.01)

(52) U.S. Cl.
CPC ..... *E21B 37/00* (2013.01); *E21B 12/00* (2013.01)

(58) Field of Classification Search
CPC ..... E21B 37/00; E21B 37/02; E21B 37/04; E21B 37/045; E21B 12/00
USPC ..... 166/170, 171, 172, 173, 174, 175, 176; 15/104.05, 104.09, 104.16
See application file for complete search history.

(56) References Cited

U.S. PATENT DOCUMENTS

| | | | | |
|---|---|---|---|---|
| 4,285,402 | A * | 8/1981 | Brieger | 166/311 |
| 4,809,793 | A * | 3/1989 | Hailey | 175/265 |
| 6,003,834 | A * | 12/1999 | Read | 251/30.01 |
| 6,152,221 | A | 11/2000 | Carmichael et al. | |
| 6,460,617 | B1 | 10/2002 | Allen | |
| 7,954,555 | B2 | 6/2011 | Ashy et al. | |
| 2005/0022995 | A1 | 2/2005 | Martin et al. | |
| 2005/0133269 | A1* | 6/2005 | Samuel | 175/61 |
| 2007/0284106 | A1 | 12/2007 | Kalman et al. | |
| 2010/0096122 | A1 | 4/2010 | Posevina et al. | |
| 2010/0126718 | A1 | 5/2010 | Lilley | |
| 2010/0243257 | A1 | 9/2010 | Krieg et al. | |
| 2011/0265988 | A1 | 11/2011 | Hern et al. | |

* cited by examiner

*Primary Examiner* — Giovanna C Wright
*Assistant Examiner* — Kristyn Hall
(74) *Attorney, Agent, or Firm* — Steve Rosenblatt

(57) ABSTRACT

A one trip method for cleaning an existing string while performing testing on the string allows in the same trip the drilling of additional wellbore. The cleanup equipment is retracted after the testing is completed so that it will not impede the advancement of the drill bit at the lower end of the string. The cleanup tools are typically extend for run in through the string and they can be collapsed by a technique such as dropping a ball to shift a sleeve to disable the piston assembly that holds the cleanup tools extended and allows them to be retracted using a return spring or other source of potential energy.

18 Claims, 3 Drawing Sheets

ONE TRIP TUBULAR CLEANING AND DRILLING ADDITIONAL OPEN HOLE

FIELD OF THE INVENTION

The field of the invention is tubular cleaning in conjunction with performing other testing and more particularly continuing single trip drilling open hole after wellbore cleanup by collapsing the wellbore cleanup tools.

BACKGROUND OF THE INVENTION

Presently, after casing is run in and cemented, the quality of the cement job is tested with a cement bond log. To ensure the success of such testing the casing or tubular string is cleaned with scrapers and related wellbore cleanup tools. The intent is to continue to make more hole after getting appropriate results from the cement bond log. In the past this has entailed as many as three trips in the hole for wellbore cleanup, testing and then drilling open hole below the string just tested.

More recently the cement testing run has been combined with the wellbore cleanup run in US Publication 2010/0126718 combines wellbore cleanup tools such as scrapers, mills, and wipers/brushes in conjunction with a cement bond log tool in a single trip as described in paragraph 123.

The present invention allows for single trip wellbore cleanup coupled with testing with the ability to continue drilling more hole. The wellbore cleanup tool is retracted after the testing in the existing tubular and then normal drilling commences with the cleanup equipment taking flow through itself so that the cuttings can be removed from the drill bit location as more hole is drilled. The cleanup tools in the retracted state do not impede drilling progress. These and other aspects of the method of the present invention will be more readily appreciated by those skilled in the art from a review of the description of the preferred embodiment and the associated drawings while appreciating that the full scope of the invention is to be found in the appended claims.

SUMMARY OF THE INVENTION

A one trip method for cleaning an existing string while performing testing on the string allows in the same trip the drilling of additional wellbore. The cleanup equipment is retracted after the cleanup is completed so that it will not impede the advancement of the drill bit at the lower end of the string. The cleanup tools are typically extended for run in and they can be collapsed by a technique such as dropping a ball to shift a sleeve to disable the piston assembly that holds the cleanup tools extended and allows them to be retracted using a return spring or other source of potential energy.

DETAILED DESCRIPTION OF THE PREFERRED EMBODIMENT

Figure 1:
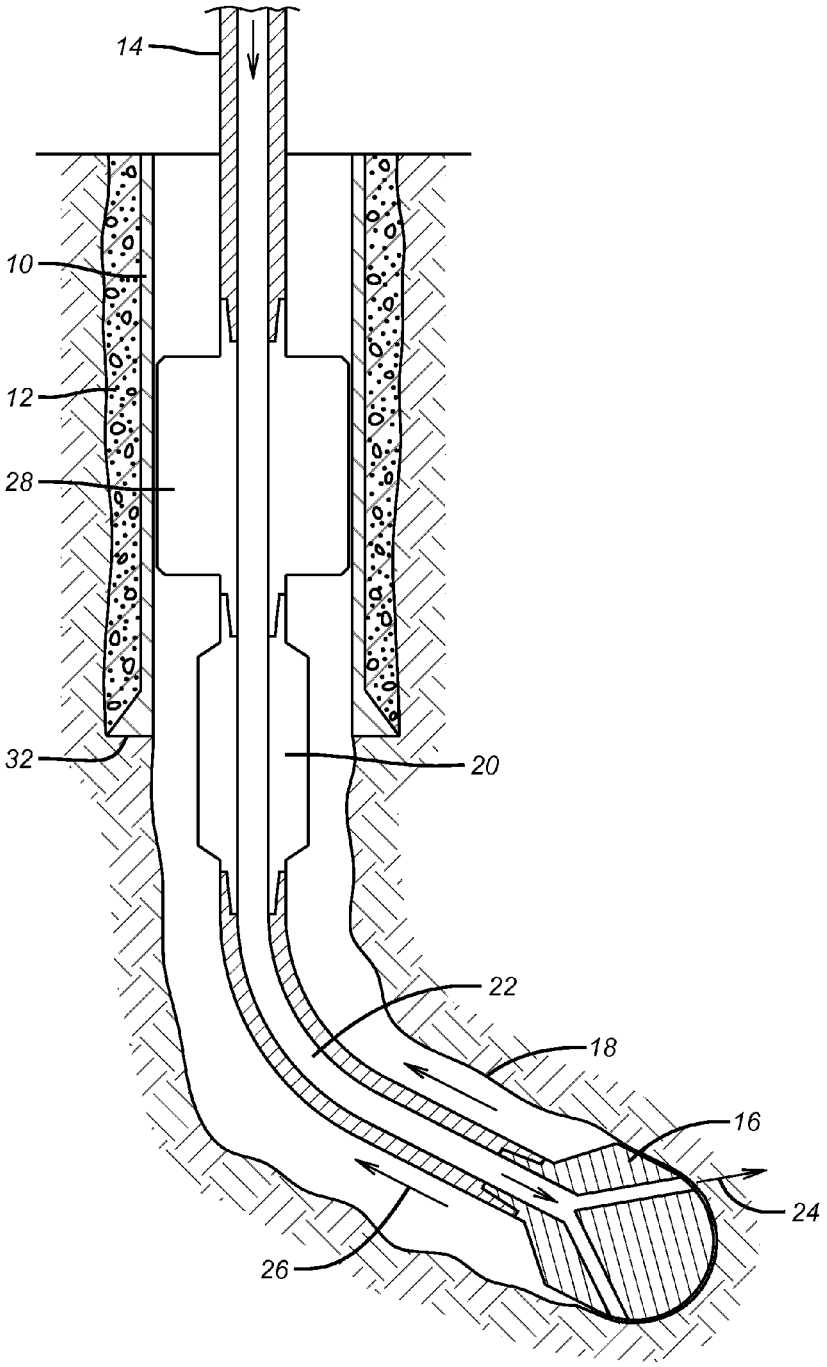
FIG. 1 shows running in with the cleanup tools actuated and performing a test downhole.

FIG. 1 illustrates casing 10 that has been cemented 12 and a drill string 14 that supports a drill bit 16 that drills open hole

18. Further up the string 14 from the bit 16 is an instrumentation package 20 that can include one or more instruments such as a cement bond logging tool and a directional drilling tool that accommodate flow through the passage 22 to the nozzles schematically represented by arrows 24 that direct cuttings back uphole as illustrated schematically by arrow 26.

The wellbore cleanup package 28 can be one or more tools that remove debris from the wall of the casing 10 by mechanical or other means where the tool has a capability of radial extension to reach the wall of the casing or other tubular 10. These tools can be run in already extended and ready to clean up or they can be actuated such as when fluid circulates through passage 22 for other purposes and raises the internal pressure which powers a piston to extend a linkage or mechanism to get contact with the wall of the casing 10 but it should also be noted that pressure or circulation is not needed to maintain these tools in wellbore cleaning mode. As long as the cleanup tools are within the casing 10 it is desirable to keep them in casing contact to do their job properly. These tools 28 can be mills with extending blades, brushes, scrapers and the like.

Ideally shortly before making an exit from the casing 10 the cleanup tools are retracted so that they do not extend to engage the newly drilled open hole 18, which would then impede the progress of the bit 16. This is the position shown in FIG. 2. The retraction feature can be manual or automatic. For example, a dropped or pumped ball can land on a seat and shift a sleeve to de-energize a energy resource such as a spring to allow the extended components to the retracted position of FIG. 2 so that the bit 16 can advance to extend the open hole 18 with the assembly 28 having a clearance to the open hole wall despite a deviation 30 in the open hole 18.

Figure 2:
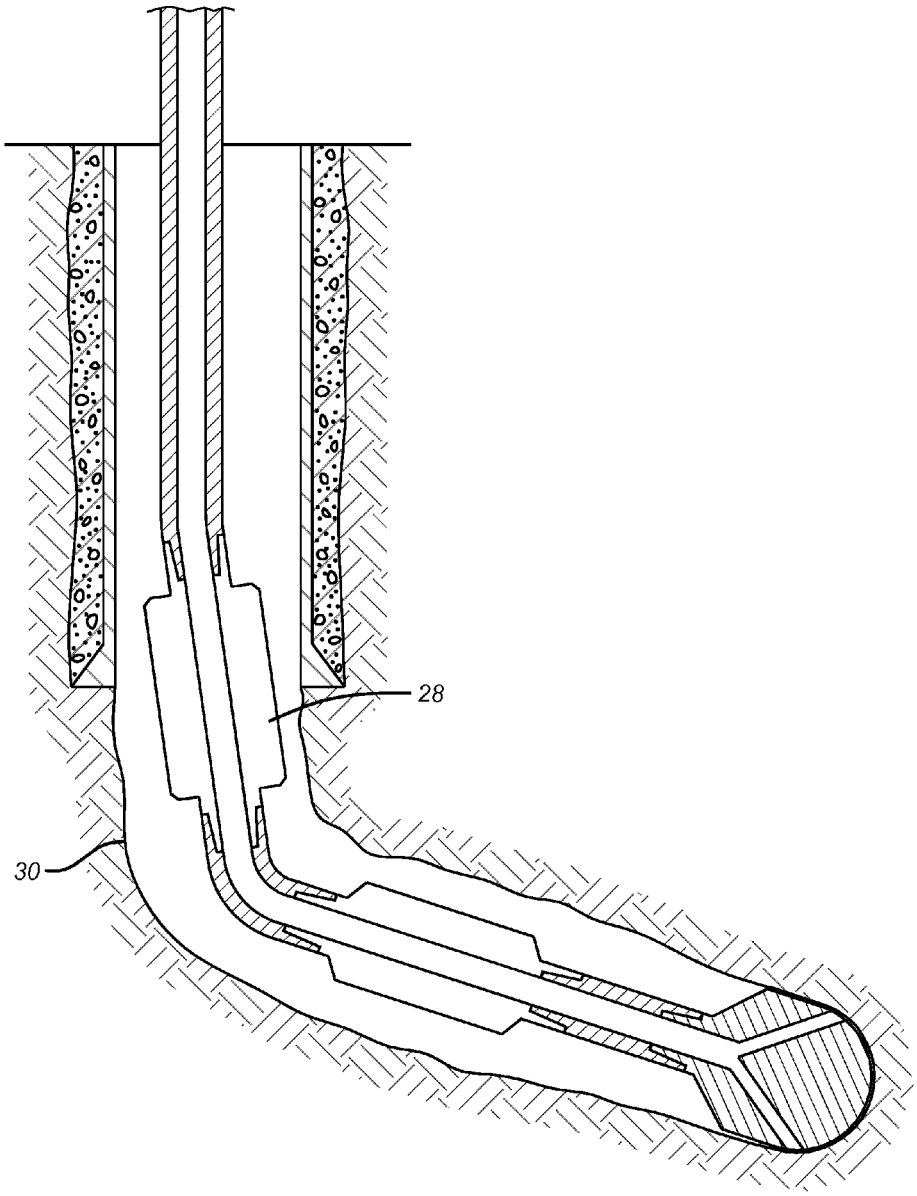
FIG. 2 is the view of FIG. 1 with the cleanup tools retracted and the string advancing to make more hole after retracting the wellbore cleanup tools.
Figure 3A:
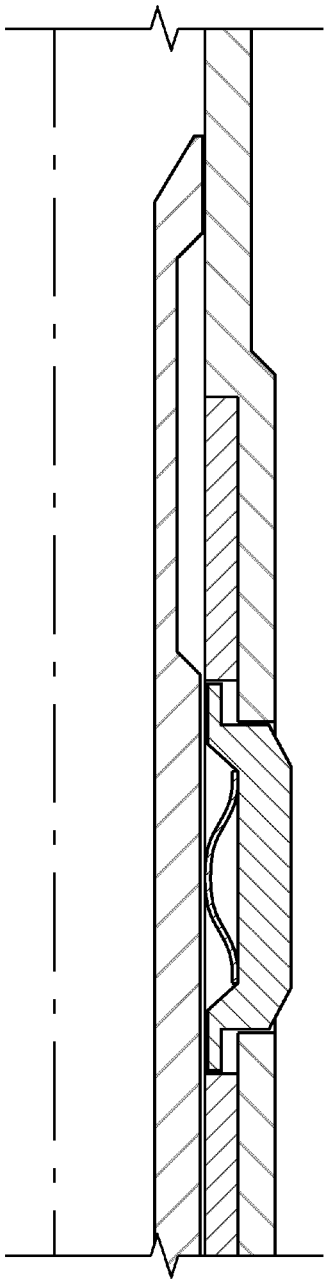
FIGS. 3*a* and 3*b* respectively show a wellbore cleanup tool in the extended run in position and in the retracted position when advanced into newly drilled open hole.
Figure 3B:
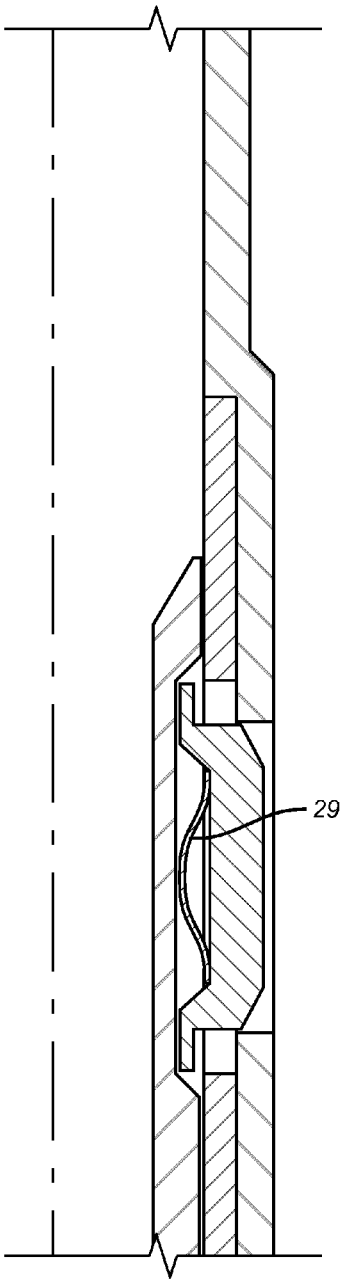

The cleanup assembly can also be automatically retracted when close to the end 32 of the casing 10. This can be done by using a casing collar locator as part of the instrument package 20 which then can trigger a component to move in the cleanup tool assembly 28 in a way to de-energize an energy resource which originally keep the tool at extended position or that the pressure of the flowing fluid no longer can drive an extension piston for the extendable component so that a stored potential energy 29 force can then retract any extending members on the assembly 28 and continue to retain the wellbore cleanup equipment 28 in a retracted position. As an added precaution, there can be a locking feature to hold the retracted position separate from the potential energy source. Alternatively, by redirection of fluid pressure to opposed sides of a double acting piston pressure can be positively used to hold such components as extendable blades from mills or scraper support arms in a retracted position so that in a single trip the open hole 18 can be drilled to the desired depth and orientation before the assembly of FIG. 2 is pulled out of the hole. Again, it is worth noting that internal pressure is not mandatory for the working position of the cleanup equipment 28 as it can be run into the hole ready to use and later be collapsed by a variety of techniques.

It should be noted that because of the one trip system, the passage 22 needs to remain open so that the bit 16 can continue to drill. Thus the pressure in passage 22 cannot just simply be turned off to get the components to retract. Flow and pressure in passage 22 need to continue to support drilling. If a ball is dropped or pumped to a seat to allow reconfiguration of the cleanup tool assembly into the retracted position where such assembly then needs to remain as it traverses the open hole just drilled, then a feature that gets the seated ball out of the passage 22 needs to be provided. This can be done in a variety of ways such as dissolving the ball and its associated seat or blowing the ball through a collapsing seat and into a ball catcher to keep the ball out of the bit nozzles 24. Alternatively the ball can be directed to a side pocket after being pumped through a seat that collapses under pressure applied to the ball when still seated. Alternatively an orifice associated with a sleeve that is responsive to developed backpressure can be used to reconfigure the cleanup tool assembly to the retracted position in response to pressure in passage 22. The sleeve itself can be displaced to a wider portion of the passage 22 after its movement has already reconfigured the assembly 28 so that pressure resumption or continuation in passage 22 actually now holds the assembly 28 retracted rather than extended as before.

Those skilled in the art will appreciate that at least one trip in the hole is eliminated with the present invention by virtue of being able to retract the cleanup tools as they get to the lower end of the tubular that for example has been cemented. In that way in a single trip a cement bond log can occur as the cleanup tools 28 that can be mounted above or below the instrumentation tools 20 can be retracted and optionally locked in that position so that the bit 16 that is already there at the lower end of the string 14 can keep on drilling without interference of the cleanup tools in the newly made open hole. Those skilled in the art will appreciate that string 14 can be rigid pipe or coiled tubing with a downhole motor so that the bit 16 can make hole. The retraction of the cleanup tools can be accomplished manually or automatically with the retracted position maintained with mechanical locking or with the use of a potential energy source such as a closure spring or internal fluid pressure redirected to a piston to draw in the extendable components.

The above description is illustrative of the preferred embodiment and many modifications may be made by those skilled in the art without departing from the invention whose scope is to be determined from the literal and equivalent scope of the claims below:

I claim:

1. A subterranean borehole drilling method, comprising:

providing a first string in an already drilled borehole having an initial formation penetration from a surface location;

running an assembly on a second string through said first string where said assembly comprises at least one retractable cleanup device and a bit at the lower end of said second string;

cleaning up said first string with said cleanup device;

advancing said bit and said cleanup device beyond said first string to extend said initial formation penetration axially into the formation to create a new wellbore segment.

2. The method of claim 1, comprising:

running in at least one measurement tool with said assembly;

obtaining information using said measurement tool;

performing said running, cleaning up, obtaining information and advancing said bit in a single trip.

3. The method of claim 2, comprising:

running said cleanup device through said first string in an extended position to clean said first string.

4. The method of claim 3, comprising:

retracting said cleanup device before said cleanup device is moved out of said first string.

5. The method of claim 4, comprising:

performing said retracting manually or automatically.

6. The method of claim 5, comprising:

locking said cleanup device after retracting said cleanup device.

7. The method of claim 5, comprising:

providing a passage through said assembly that ends adjacent at least one nozzle at said bit;

using pressure in said passage to selectively extend and retract said cleanup device.

8. The method of claim 7, comprising:

reconfiguring said cleanup device from extending in response to passage pressure to retracting in response to passage pressure by changing pressure in said passage to a predetermined level.

9. The method of claim 7, comprising:

leaving said passage open to flow after said reconfiguring said cleanup device in either of said extended or retracted positions.

10. The method of claim 5, comprising:

using a potential energy source on said cleanup device to retain cleanup device in said retracted position.

11. The method of claim 4, comprising:

retracting said cleanup device to a smaller dimension than the open hole made by said bit.

12. The method of claim 5, comprising:

sensing with said measurement tool the location of said cleanup device with respect to a lower end of said first string;

retracting said cleanup device before said cleanup device exits into an open hole drilled by said bit.

13. The method of claim 12, comprising:

counting casing collars with said measurement tool to perform said sensing.

14. The method of claim 2, comprising:

performing a cement bond log of said first string with said measurement tool.

15. The method of claim 2, comprising:

providing a directional drilling tool as said measurement tool.

16. The method of claim 2, comprising:

using as said cleanup device at least one of a mill, scraper tool, and brushes.

17. The method of claim 2, comprising:

said cleanup device is located further from said bit than said measurement tool.

18. The method of claim 2, comprising:

said cleanup device is located closer to said bit than said measurement tool.

* * * * *